US005579736A

United States Patent [19]

Nakamura et al.

[11] Patent Number: 5,579,736

[45] Date of Patent: Dec. 3, 1996

[54] COMBUSTION CONTROL SYSTEM FOR INTERNAL COMBUSTION ENGINE

[75] Inventors: Kazuhiro Nakamura; Kimihiro Nonaka, both of Hamamatsu, Japan

[73] Assignee: Sanshin Kogyo Kabushiki Kaisha, Hamamatsu, Japan

[21] Appl. No.: 299,517

[22] Filed: Sep. 1, 1994

[30] Foreign Application Priority Data

| | | | |
|---|---|---|---|
| Sep. 1, 1993 | [JP] | Japan | 5-217768 |
| Sep. 1, 1993 | [JP] | Japan | 5-217769 |
| Sep. 10, 1993 | [JP] | Japan | 5-225988 |

[51] Int. Cl.[6] ..... F02D 17/00; F02D 43/00

[52] U.S. Cl. ..... 123/339.11; 123/413; 123/423; 123/481; 123/493

[58] Field of Search ..... 123/400, 413, 123/423, 478, 481, 493, 339.11, 339.1

[56] References Cited

U.S. PATENT DOCUMENTS

| | | | |
|---|---|---|---|
| 4,071,002 | 1/1978 | Frahm | 123/413 |
| 4,984,540 | 1/1991 | Morikawa | 123/73 C |
| 4,986,239 | 1/1991 | Oishi | 123/413 |
| 5,038,739 | 8/1991 | Ishii | 123/481 |
| 5,273,016 | 12/1993 | Gillespie et al. | 123/413 X |

FOREIGN PATENT DOCUMENTS

| | | | |
|---|---|---|---|
| 56-115854 | 9/1981 | Japan | 123/413 |

*Primary Examiner*—Tony M. Argenbright
*Attorney, Agent, or Firm*—Knobbe, Martens, Olson & Bear

[57] ABSTRACT

In engine idle, a throttle valve is set to an intermediate position between the closed position and the open position, which provides a substantial opening for air flow. When an accelerator is initiated, the sufficient air flow amount and speed are already attained in the engine, the engine rotation quickly increases in response to the accelerator movement. During the period before the accelerator arrives at a pick-up position, an electric control unit controls ignition timing in response to the accelerator movement. The amount of fuel injected to the engine is also controlled depending on the accelerator movement. Also during this period, one or more cylinders are set to be inactive by not supplying the fuel thereto. Thus, the engine rotation speed is controlled to be low at idle. In engine deceleration, when the engine is in the range where a backfire tends to occur, the rate of change in the ignition delay and the amount of fuel injection are adjusted depending on the engine rotation speed, the ignition delay and the other physical parameters. In the range where backfire is likely to happen, the rate of change in the ignition delay timing is controlled to be smaller and the amount of fuel injection is controlled to be larger, which will suppress the backfire in deceleration.

31 Claims, 10 Drawing Sheets

COMBUSTION CONTROL SYSTEM FOR INTERNAL COMBUSTION ENGINE

BACKGROUND OF THE INVENTION

This invention relates to a combustion control system for an internal combustion engine and more particularly to a combustion control system for improving engine characteristics in acceleration, idle and deceleration.

In an outboard motor, for example, there is a need to improve acceleration characteristics from an idle state, for example, in a trolling state, to a high engine rotation speed, which requires a rapid increase of an engine rotation. For such acceleration, it is necessary to supply a large amount of air to the engine in response to an accelerator of the motor. However, in a conventional engine, even though a throttle valve is fully opened within a very short period of time, because of an inertia effect of air, it is not possible to introduce sufficient air corresponding to the throttle opening to an inside of the engine within a short period of time. Therefore, there is a limit in the conventional engine to rapidly increase the acceleration.

It is, therefore, a principal object of the present invention to provide an improved combustion control system for an internal combustion engine that is capable of rapidly increasing the engine acceleration from an idle state by providing an increased air flow and flow rate through the throttle valve in the idle state.

According to the present invention, the combustion control system for an engine is so arranged that a throttle valve is substantially opened even in an idle state to provide an sufficient air flow to the engine in response to the fast change-over from the idle to the acceleration. However, in such a situation, since the air flow rate and the air flow velocity are relatively higher in the idle state, the engine rotation rate inevitably becomes higher during the idle. To lower the engine rotation rate in such a situation, in the present invention, ignition timing in the engine is controlled to be fully retarded during the idle. However, since the timing retard tends to be emphasized when the engine is decelerated, what is called a backfire is created, which may be uncomfortable to a user.

It is, therefore, a further object of the present invention to provide a combustion control system that has a fuel injector which is controlled such that a lower rotation speed in the engine is maintained in the idle state even when the throttle valve is substantially opened.

It is a further object of the present invention to provide a combustion control system that has a fuel injector which is controlled to selectively cease fuel injection for one or more cylinders of the engine when the engine is in the idle state.

It is a further object of the present invention to provide a combustion control system for an engine which is capable of suppressing a backfire of the engine when the engine is decelerated.

It is a further object of the present invention to provide a combustion control system for an engine which is capable of controlling a rate of change in a retard ignition timing based on the rotation rate of the engine, the ignition timing and other physical parameters.

It is a further object of the present invention to provide a combustion control system for an engine which is capable of suppressing a backfire of the engine in the deceleration state by controlling a fuel injector so that an air-fuel ratio is increased.

SUMMARY OF THE INVENTION

First feature of the invention is embodied in a combustion control system for an internal combustion engine which is capable of rapidly increasing the engine acceleration from an idle state by providing an increased air flow and flow rate in the idle state. The combustion control system includes a throttle valve for controlling air flow through an opening thereof based on its angular movement. The throttle valve has an idle position which has a substantial opening for providing a sufficient air flow to the engine. A cam member is provided which is rotatably movable in response to an accelerator to regulate a rotation rate of the engine. The cam member disengages with the throttle valve in a first region prior to a pick-up position and engages with the throttle valve in a second region after the pick-up position to proportionally drive the throttle valve. An electric control unit (ECU) is provided for controlling an overall procedure for the combustion control of the present invention. The control unit receives information on the amount of movement of the cam member and the rotation rate of the engine and changes ignition timing for the engine on the basis of this information.

In accordance with a first feature of the invention, since the idle position of the throttle valve is set to an intermediate position between the conventional idle position and the full open position, sufficient air flow amount and air flow speed for the rapid acceleration are already established in the idle state of the engine. Therefore, the combustion response in the engine can quickly follow the acceleration movement from the idle to the maximum speed.

Moreover, the ECU controls the ignition timing depending on the amount of movement in the cam member until the cam member reaches the pick-up position. Namely, in the idle, the ignition timing is controlled to be retarded, which can suppress the increase of the engine rotation speed even though the increased air flow amount and speed is supplied to the engine. With departure from the idle state, the ignition timing is controlled toward the advanced timing in response to the amount of movement in the cam member. As a consequence, the combustion in the engine is promoted to further improve the acceleration characteristics for attaining the high rotation rate from the idle within a short period of time.

The present invention further includes a fuel injector for injecting fuel to the engine within a predetermined time under the control of the electric control unit. The fuel injector is controlled so that amount of fuel injected in a unity of time is decreased with the decrease in the amount of the cam member movement when the cam member is in the first region, i.e., during the time which the throttle valve is in the idle position. Therefore, because of the reduced fuel injection in the idle, the combustion in the engine is suppressed to maintain the lower rotation rate. When the accelerator movement (cam position) increases, the fuel injection per unit time increases accordingly. Since the sufficient air flow amount and speed have already been achieved in the throttle valve, the increased fuel injection in proportion to the accelerator movement further promote the prompt response in the acceleration.

Another aspect of the present invention is embodied in a combustion control system for an internal combustion engine which is capable of selectively suspending the combustion in one or more cylinders of the engine. The combustion control system includes a throttle valve for controlling air flow through an opening thereof based on its angular movement. The throttle valve has an idle position which has a substantial opening for providing a sufficient air flow to the engine. A cam member is provided which is rotatably movable in response to an accelerator to regulate a rotation rate of the engine. The cam member disengages with the throttle valve in a first region prior to a pick-up position and engages with the throttle valve in a second region after the pick-up position to proportionally drive the throttle valve. An electric control unit (ECU) is provided for controlling an overall procedure for the combustion control of the present invention. The control unit receives information on the amount of movement of the cam member and the rotation rate of the engine and changes ignition timing for the engine on the basis of this information. A fuel injector is provided for injecting fuel to the engine within a predetermined time which is controlled by the ECU so that amount of fuel injected in a unity of time is decreased with the decrease in the cam member movement when the cam member is in the first region. Means for selecting one or more cylinders is provided for selectively pausing combustion in one or more cylinders when the cam member is in the first region.

In accordance with this invention, during the period before the cam member reaches the pick-up position, one or more cylinders are set to be inactive by not supplying the fuel thereto. Thus, even though there is provided sufficient air flow to the engine in the idle, the overall engine rotation speed is controlled to be low. Furthermore, since such change-over between active and inactive states in the selected cylinders is performed within the range where the throttle valve is unchanged (idle position), the combustion switching between the active and inactive in the cylinders is accomplished smoothly with high stability. In the present invention, the ignition for all of the cylinders are continued to be provided even though the fuel supply is suspended for the selected cylinders. As a result, it is possible to prevent the fuel which has not been fired from being exhausted from the engine, since the fuel may still be left in the selected cylinder immediately after the fuel supply is ceased. Because such unfired fuel from the engine is harmful to human health or environment protection, to supply the ignition to fire any remaining fuel in the cylinder is effective to prevent such harm.

Another aspect of the present invention is embodied in a combustion control system for an internal combustion engine which is capable of suppressing a backfire which may occur in the deceleration of the engine. The combustion control system of this invention includes a throttle valve for controlling air flow through an opening thereof based on its angular movement. The throttle valve has an idle position which has a substantial opening for providing a sufficient air flow to the engine. A cam member is provided which is rotatably movable in response to an accelerator to regulate a rotation rate of the engine. The cam member disengages with the throttle valve in a first region prior to a pick-up position and engages with the throttle valve in a second region after the pick-up position to proportionally drive the throttle valve. An electric control unit (ECU) is provided for controlling an overall procedure for the combustion control of the present invention. The control unit receives information on the amount of movement of the cam member and the rotation rate of said engine and controls ignition timing for the engine. The control unit adjusts the rate of change in the ignition timing during deceleration of the engine. Such adjustment of the rate of change in the ignition timing is made by judging, on the basis of said engine rotation rate and the amount of said ignition timing, whether the engine is in a range which is likely to cause a backfire. A fuel injector is provided for injecting fuel to the engine within a predetermined time. The fuel injector is controlled by the ECU so that the amount of fuel injected to said engine per cycle is increased during the engine deceleration and when the engine is in the range which is likely to cause the backfire.

In accordance with this invention, during the engine deceleration and when the engine is in the range where the backfire tends to occur, the rate of change in the ignition delay is adjusted depending on the engine rotation speed, the ignition timing delay and the other physical parameters. In the range where the backfire likely to happen, the rate of change in the ignition delay timing is controlled to be smaller so that the ignition timing will change slowly and smoothly, which will suppress the backfire in the deceleration. Furthermore, in the engine deceleration, the ECU controls the fuel injector so that the amount of fuel provided to the engine will increase. Therefore, such an increase in the fuel make the air/fuel mixture rich, which will further suppress the backfire in the engine during the deceleration.

DETAILED DESCRIPTION OF THE PREFERRED EMBODIMENT OF THE INVENTION

Figure 1:
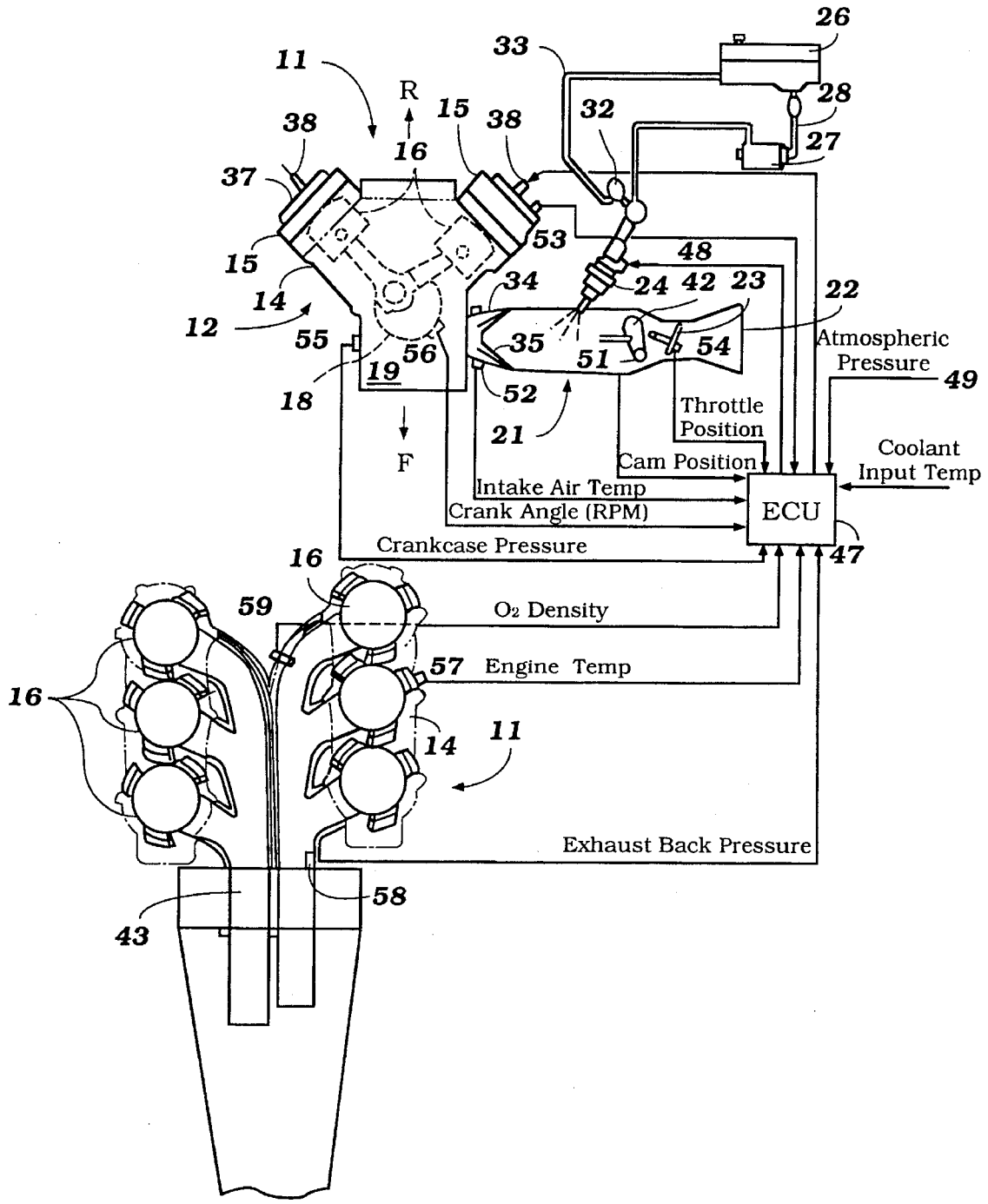
FIG. 1 is a partially schematic view of an outboard motor incorporating an internal combustion engine having a combustion control system constructed and operated in accordance with the present invention.

Referring now in detail to the drawings and initially to FIG. 1, an outboard motor is shown partially in cross section and with portions shown in phantom and is identified generally by the reference numeral 11. This view is composite view and a single cylinder of the powering internal combustion engine is shown in cross section with the engine being identified generally by the reference number 12 and associated induction system and fuel injection system for it shown partially in cross section and partially schematically. The invention is described in conjunction with an outboard motor only as a typical environment in which the invention may be practiced. The invention has particular utility with two cycle crankcase compression internal combustion engines and since such engines are frequently employed as the power plants for outboard motors, an outboard motor is a typical environment in which the invention may be employed. However, the present invention is also applicable to other engine such as four cycle engines.

The outboard motor 11, as already noted, includes a powering internal combustion engine 12 which, in the illustrated embodiment, is comprised of a six cylinder V-type (V-6) engine. It will be readily apparent to those skilled in the art how the invention can be employed in connection with engines of other configurations.

The engine 12 forms a portion of the power head of the outboard motor and this power head is completed by a protective cowling (not shown) which surrounds the engine 12 in a known manner. As may be seen in this figure, the engine 12 is comprised of two cylinder blocks 14 each of which includes three aligned cylinder bores 15. Pistons 16 reciprocate in the cylinder bores 15 and are connected to connecting rods 17 which, in turn, drive a crankshaft 18 in a well known manner. The crankshaft 18 is rotatably journaled within a crankcase assembly which is divided into individual chambers 19 each associated with a respective one of the cylinder bores 15 and which are sealed from each other in a manner well known in the art.

A fuel/air charge is delivered to the crankcase chambers 19 by an induction system, indicated generally by the reference numeral 21, and which includes an atmospheric air inlet 22. The induction system 21 includes a throttle valve 23 having a pick-up bar 25 which is orthogonally attached to the throttle valve 23 as shown in the enlarged view of FIG. 2. As is well known in the art, the throttle valve 23 determines the amount air introduced to the crankcase chambers 19.

Figure 2:
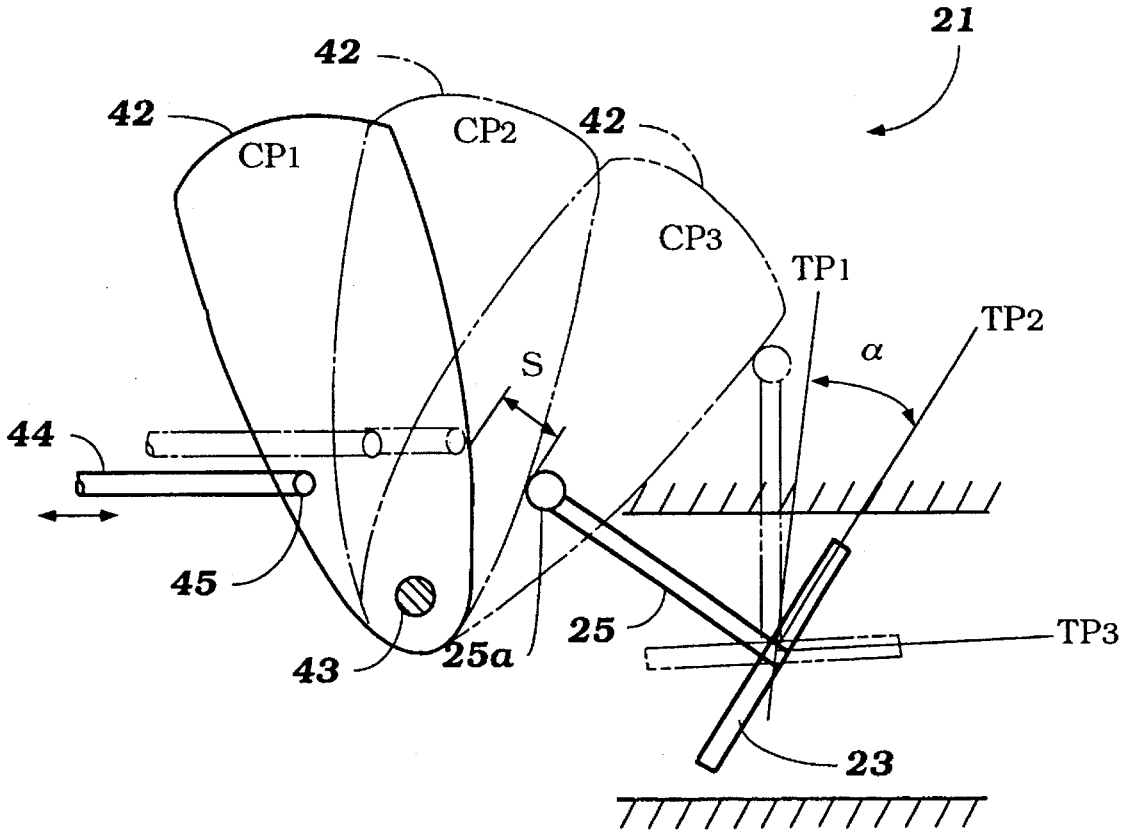
FIG. 2 is a block diagram showing positions and movements of a cam member and a throttle valve in an air induction system of the combustion control system shown in FIG. 1.

Also in FIG. 2, the induction system 21 further includes a cam mechanism 41 having a cam member 42 and an accelerator bar 44. The accelerator bar 44 is connected to the cam member 42 through a pin 45. The other end of the accelerator bar 44 is connected to an accelerator pedal (not shown) to provide a stroke which corresponds to the desired acceleration to the throttle valve 23. The cam member 42 is pivotally connected to the induction system so that it can rotate around a pin 43. The pick-up bar 25 of the throttle valve 23 has a contact portion 25*a* at its end to contact with the circumference of the cam member 42 when the cam member 42 is driven by the accelerator bar 44.

In FIG. 1, an electronically operated fuel injector 24 sprays fuel into the induction system 21 downstream of the throttle valve 23. The fuel injector 24 receives fuel from a fuel system including a remotely positioned fuel tank 26. Fuel is drawn from the fuel tank 26 by means of a high pressure fuel pump 27, through a conduit 28 in which a filter 29 is positioned. This fuel then delivered to a fuel rail 31 in which a pressure regulator 32 is provided. The pressure regulator 32 maintains the desired pressure in the fuel rail by bypassing excess fuel back to the fuel tank 26 through a return conduit 33. The operation of the fuel injector 24 will be described in more detail later.

The induction system 21 delivers air to the intake ports of the engine through reed type check valves 35 which operate to preclude reverse flow. The inducted charge is drawn into the crankcase chambers 19 upon upward movement of the pistons 16 and then is compressed upon downward movement. The compressed charge is then transferred to the area above the pistons 16 through a plurality of scavenge passages (not shown) in a manner well known in this art.

A cylinder head 37 is affixed to the cylinder block 14 in a known manner and defines a recess which forms part of the combustion chamber. A spark plug 38 is mounted in each cylinder recess and is fired by the ignition system in a known manner. An ignition signal for each spark plug 38 is provided through an electric line from an ECU (electronic control unit) 47. The timing of the ignition is precisely controlled by the ECU 47 as will be described later.

As is typical with outboard motor practice, the cylinder block 14 and cylinder head 37 are formed with cooling jackets through which coolant is circulated from the body of water in which the outboard motor 11 is operating in any conventional manner.

Referring now in more detail to the induction system, the fuel injection system and the control therefor, as previously noted, the movement of the throttle valve 23 and the cam member 42 in the induction system 21 is monitored. And the ignition timing for the spark plug 38 and the fuel injection for the crank chambers 19 from the fuel injector 24 are electronically controlled.

To this end, the induction system 21 is provided with a throttle valve position sensor 54 which senses the position, i.e., angular movement, of the throttle valve and outputs the sensed signal to the ECU 47. The induction system 21 is further provided with a cam position sensor 51 which senses the position, i.e., angular movement, of the cam member and outputs the resulting signal to the ECU 47. The combustion control system of the present invention further includes various sensors which will be described later.

The fuel injector 24 is provided with an electrical terminal that receives an output control signal from an ECU through a conductor indicated by the line 48. A solenoid of the fuel injector 24 is energized with the ECU 47 outputs a signal to the fuel injector 24 through the line 48 to open an injection valve and initiate injection. Once this signal is terminated, injection will also be terminated. The injector 24 may be of any known type and in addition to a pure fuel injector, it may comprise an air/fuel injector.

A number of ambient atmospheric conditions are supplied to the ECU and certain engine running conditions are supplied to the ECU 47 so as to determine the ignition timing by the ignition system, the amount of fuel injected and the timing of the fuel injection by the fuel injector 24. These ambient conditions may comprise atmospheric pressure which is measured in any suitable manner by a sensor and which signal is transmitted to the ECU 47 through a conductor 49, temperature of the cooling water which is delivered to the engine cooling jacket from the body of water in which the watercraft is operating as sensed by an appropriate sensor (not shown) and transmitted to the ECU 47 through a conductor, and the intake air temperature as sensed in the crankcase chamber 19 by a temperature sensor 52 which outputs its signal to the ECU 47 through a conductor. Additional ambient conditions may be measured and employed so as to provide more accurate control of the fuel injection, if desired.

In addition to the throttle valve position sensor and the cam position sensor as noted above, there are also provided a number of engine condition sensors which sense the following engine conditions. An in-cylinder pressure sensor 53 senses the pressure within the cylinder and outputs this signal to the ECU 47 through an appropriate conductor. Crankcase pressure is sensed by a pressure sensor 55 which is also mounted in the crankcase chamber 19 and outputs its signal to the ECU 47. Crank angle position indicative of the angular position and rotating speed of the crankshaft 18 is determined by a sensor 56 and outputted to the ECU 47. Engine temperature or intake air temperature is sensed by a sensor 57 mounted in the cylinder block 14 and inputted to the ECU 47. Exhaust system back pressure in the expansion chamber 43 is sensed by a sensor 58 and is outputted to the ECU 47. Finally, a sensor 57 outputs a signal indicative of the density of dioxide in the exhaust gas in the expansion chamber to the ECU 47.

As with the ambient conditions, additional engine running conditions may be sensed. Those skilled in the art can readily determine how such other ambient or running conditions can be sensed and fed to the ECU 47 and processed by the ECU 47 to determine the ignition timing and the fuel injection supply both in timing and amount. The ECU is provided with an information table or a map for determining the ignition timing and the fuel supply based on the various parameters in the engine as above which will be described in detail later.

Improving Acceleration Response from Idle State

One of the features of the present invention resides in the fact that the throttle valve is substantially opened when the engine is in the idle state so that the large amount of air flow can be provided to the engine in response to the accelerator operation immediately after the idle state. FIG. 2 shows such a situation in the combustion control system of the present invention.

In FIG. 2, there is shown positional relationship between the cam member 42 and the throttle valve 23 in the induction system 21 of the present invention. When the engine is idling, the cam member 42 is in the position designated by CP1. In the conventional combustion system, in such an idle state of the engine, the throttle valve is positioned at TP1 shown in the figure. In the position TP1, the throttle valve has a very small opening for providing an air to the cylinder enough to keep the slow rotation in the engine. For example, the throttle valve has an angle of 2–3 degrees from a complete close position. However, as noted above, the air flow will not change in response to a quick opening in the throttle valve position, from the idle position TP1 to the full open position TP3 for example, because of the inertia of the air. Therefore, in the conventional engine, it is not possible to increase the engine rotation rate in a short period of time.

In the present invention, during the idle, the throttle valve 23 is adjusted to a position TP2 when the cam member 42 is in the idle position CP1 (shown by the dotted line). In the position TP2, the throttle valve 23 has, for example, an angle $\alpha$ of 15–20 degrees from the complete close position TP1, which is substantially larger than the conventional angle of 2–3 degrees as mentioned above. Thus, the throttle valve 23 is stopped by a mechanism (not shown) from further closing an air path. In this situation, there is a gap S between the contact portion 25*a* of the pick-up bar 25 and the circumference of the cam member 42 as shown in FIG. 2. As a result, even when the engine is idling, the sufficient air flow for the rapid acceleration is already preserved in the induction system 21. Other type of throttle valves may also be applicable to the present invention, for example, a throttle valve having through holes or grooves to provide a substantial air flow in the complete close position TP1 of FIG. 2.

In response to the accelerator movement, the cam member 42 shift its position from the idle position CP1 to the pick-up position CP2 (shown by dashed line). This is the position where the contact portion 25*a* of the pick-up bar 25 contact with the circumference of the cam member 23 while throttle valve 23 remain in the idle position TP2. After this position, the throttle valve 23 shift its position in proportion to the movement of the cam member 42. Therefore, when the cam member 42 is driven by the accelerator bar 44 to the position CP3 (shown by two dot dashed line), the contact portion 25*a* slide along the circumference of the cam member 42 so that the throttle valve 23 is placed to the full open position TP3. In the full open position TP3, the throttle valve 23 provides the largest amount of air flow with the highest flow speed to the cylinder and the engine rotation rate will become maximum.

The positions of the cam member 42 and the throttle valve 23 are constantly monitored by the sensors 51 and 54, respectively. The sensors 51 and 54 send the sensed signals to the ECU 47. The ECU 47 is also provided with other signals from the various sensors in the engine as describe above. These parameters are used as the basis of combustion control procedure of the present invention.

As briefly noted above, the ECU 47 stores therein various maps (information table) for selecting an ignition timing, a fuel injection timing and an injection amount based on the engine rotating speed, the cam position and the throttle position. There are three maps related to the air flow control in the induction system 21. The first map is for a state where the cam member 42 is in the idle position CP1, the second map is for a state where the cam member is in the range between the idle position CP1 and the pick-up position CP2, and the third map is for a state where the cam member 42 is in the range between the pick-up position CP2 and the full open position CP3 in FIG. 2.

There are other maps which are related to further aspect of the present invention. One of them relates to a process for determining the operation of pausing the combustion in a selected cylinder. The other map relates to a process for deceleration stage to decide whether the engine is in a specific area wherein a backfire likely to be initiated and suppress such a backfire.

Figure 3:
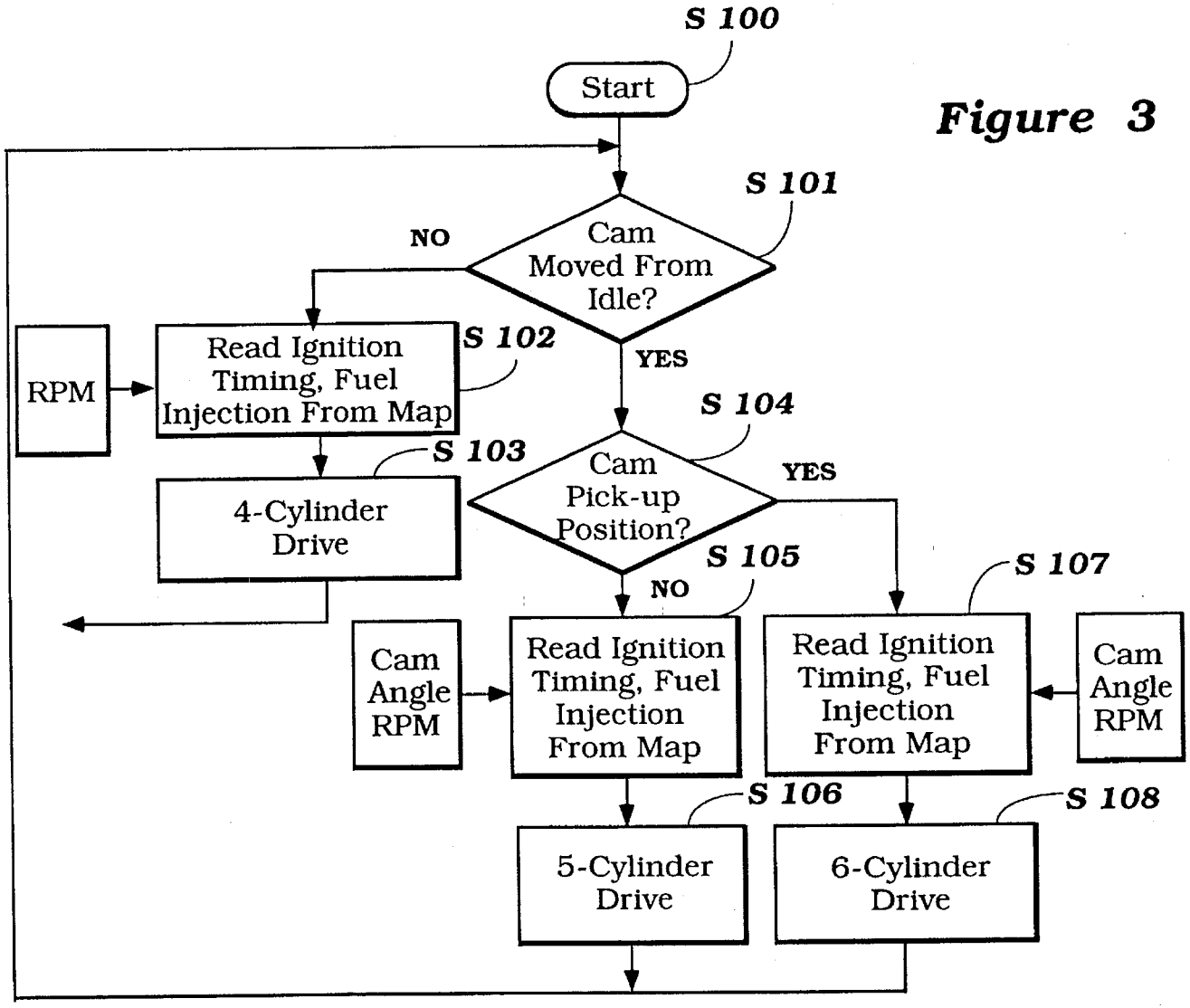
FIG. 3 is a flow chart showing the control routine for an idle state and an acceleration state of the engine according to the combustion control system of the present invention.
Figure 4:
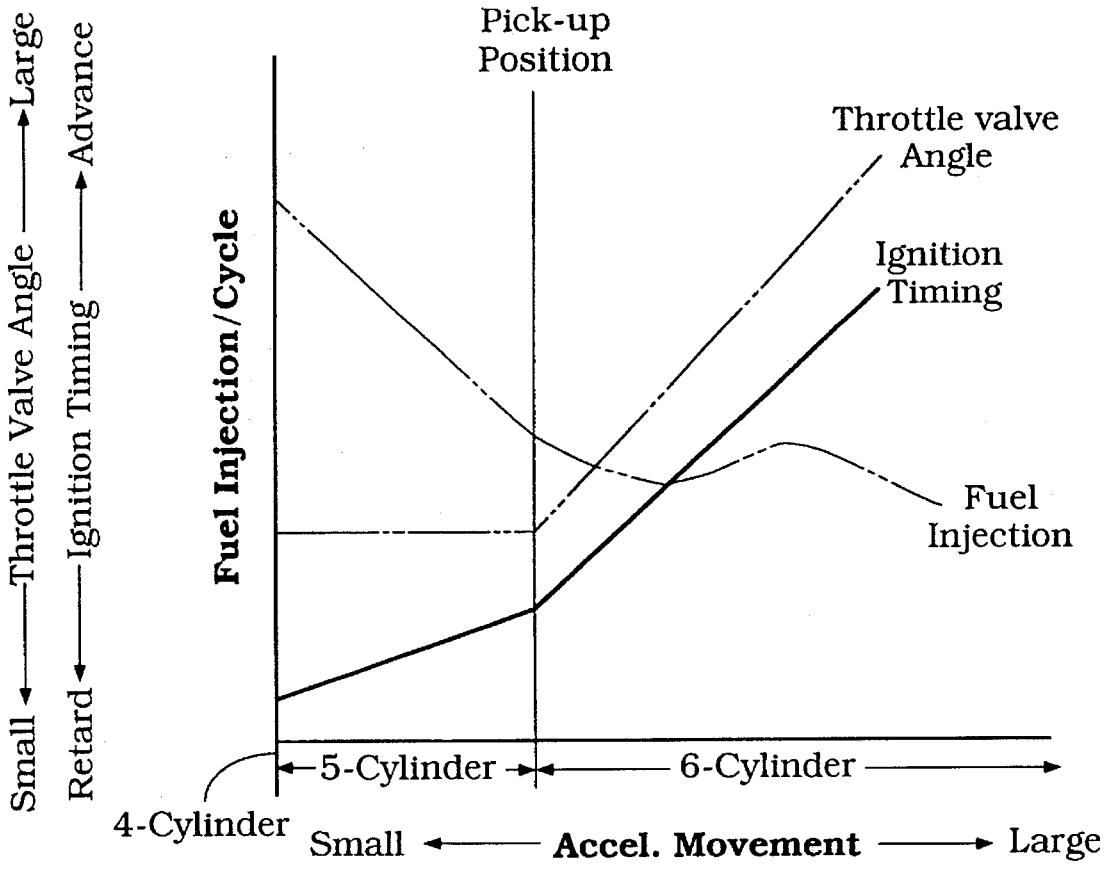
FIG. 4 is a graphical view showing co-relationship between the accelerator movement, the opening rate in the throttle valve, the ignition timing and the fuel injection per cycle.

This control routine will now be described by reference to FIGS. 3 and 4. FIG. 3 is a flow chart showing the control routine in the combustion control system of the present invention for air flow in the engine with respect to the idle and acceleration states, and associated control such as ignition timing and fuel injection. FIG. 4 is a graphical view showing co-relationship between the accelerator movement, the rate of throttle valve opening, the ignition timing and the fuel injection. As noted above with reference to FIG. 2, the throttle valve 23 remains in the idle position TP2 which allows a large amount of air flow to the engine during the range between the idle position CP1 and the pick-up position CP2 of the cam member 42. This arrangement realizes a quick response in the acceleration from the idle state in the engine since the large amount of air flow to the crank chamber 19 is already accomplished.

Basically, the combustion control system operates to initially control the fuel injection amount and timing and the ignition timing in response to this movement of the cam member 42 connected to the accelerator. The system also operates to control how many cylinders should be driven, i.e., which cylinders should be inactive depending on the position of the cam member 42. As also noted above, the ECU 47 stores the first, second and third maps for this routine.

In FIG. 3, once the program starts in the step S100, it moves to the step S101 so as to determine whether the cam member 42 has moved from the idle position CP1 of FIG. 2. This movement is sensed by the sensor 51 in the induction system 21 and notified to the ECU 47. If there is no movement, i.e., the cam member 42 stays in the idle position CP1, the program moves to the step S102 wherein the ignition timing, the fuel injection amount and timing are determined from the reading in the first map.

In the next step S103, the spark plug 38 and the fuel injector 24 are controlled based on the data obtained from the first map. As noted above, the throttle valve 23 is in the idle position TP2 which forms a substantially larger opening than that of the conventional idle state. Thus, a substantially amount of air flows through the throttle valve 23. In this idle state, it is preferable to reduce the number of active cylinders in the engine. For example, in the preferred embodiment, the engine is so controlled that four (4) out of six (6) cylinders are in operation. That is, the selected two cylinders are controlled to be inactive by, for example, not providing gas from the fuel injector 24 to the two selected cylinders. Even though the fuel is not provided to the selected cylinders, it is preferable to provide ignition to the spark plug 38 of each of the selected cylinders to prevent the unfired gas from expelled from the engine, which will be described in more detail later.

Further in the engine idle, the ignition timing is controlled so that it is more delayed when the accelerator movement is smaller as illustrated in FIG. 4. Because of this retard timing, even though the throttle valve 23 is substantially opened and thus the air flow amount and speed are increased, the combustion in the engine is suppressed so as not to increase the rotating speed in proportion to the throttle valve opening. Engine speed is calculated by using the output of the crank angle sensor 56 in relation to time to measure the engine rotational speed. Preferably, in this state, the rate of fuel injection (fuel injection amount within unity of time) will be decreased. Even though the fuel injection rate is decreased, the fuel supplied to the engine per cycle will be increased since the engine rotation speed is lowered by the ignition timing as shown in FIG. 4. However, the total amount of fuel supplied to the engine in a fixed time is decreased because the rate of fuel injection per unit time is lowered. As a result, the engine rotating speed in the idle is further stabilized to remain low.

After the setting in the step S103, the program returns to the step S101. In the step S101, If it is determined that the cam member 42 has departed from the position CP1, i.e., there is an accelerator movement, the process advances to step S104. In the step S104, it is determined whether the cam member 42 reaches the pick-up position CP2 (FIG. 2). If the cam member is not in the pick-up position CP2, the program moves to step S105 wherein the ignition timing, the fuel injection amount and timing are determined from the reading in the second map. The values in the map vary depending on the position (cam angle) of the cam member 42 and the engine rotation speed. The position of the cam member 42 and the engine rotation speed are detected by the sensors 56 and 51, respectively. As noted above, since the cam member 42 is not in the pick-up position CP2, the throttle valve 23 is still in the idle position TP2 which forms a substantially larger opening than that of the conventional idle state.

In the next step S106, the ignition timing in the spark plug 38 and the fuel injector 24 are controlled based on the data obtained from the second map. In the preferred embodiment, the ignition timing and the fuel injector 24 are controlled so that five (5) out of six (6) cylinders are driven while the selected one cylinders is inactive. In this situation, the ignition timing is controlled so that the retard angle is decreased with the increase of the accelerator movement as shown in FIG. 4. Because of this ignition timing and the sufficient air flow through the throttle valve 23, the engine rotation rate will quickly increase in response to the accelerator movement.

Furthermore, with the increase of the accelerator movement, the rate of fuel injection will also be increased until the cam member reaches the pick-up position CP2 of FIG. 2. Although the fuel supplied to the engine per cycle may look decreased because the engine rotation speed is increasing, the total amount of fuel supplied to the engine in a fixed time is increased because the rate of fuel injection and the rotating speed are increased. As a result, the combustion in the engine is promoted to further improve an acceleration response in the engine. After this step, the process returns to the steps S101 and S104.

If it is determined that the cam member 42 reaches the pick-up position CP2 in the step S104, the program moves to step S107 wherein the ignition timing, the fuel injection amount and timing are determined from the reading in the third map. Such reading may vary depending on the position (cam angle) of the cam member 42, i.e., the accelerator movement, and the engine rotation speed. In the next step S108, the engine combustion is controlled according to the readout data. In this setting, all of the six cylinders are driven by providing the fuel and the ignition thereto. Also in this situation, the throttle valve 23 rotates from the idle position TP2 in proportion to the movement of the cam member 42 until the throttle valve 23 is fully opened at the position TP3 as shown in FIG. 2. In the preferred embodiment of the present invention, the rate of fuel injection per time becomes constant after the pick-up position CP2 to the full open position CP3 of the cam member 42. After the operation in the step S108, the program returns to the step S101.

As has been described, since the idle position of the throttle valve 23 is set to an intermediate position between the conventional idle position and the full open position, sufficient air flow amount and air flow speed for the rapid acceleration are already established in the idle state of the engine. Therefore, the combustion response in the engine can quickly follow the accelerator movement from the idle to the maximum speed.

Moreover, the ECU 47 controls the ignition timing depending on the amount of movement in the cam member 42 until the cam member 42 reaches the pick-up position CP2. Namely, in the idle, the ignition timing is controlled to be retarded, which can suppress the increase of the engine rotation rate even though the increased air flow amount and flow speed. With departure from the idle state, the ignition timing is controlled toward the advanced timing in response to the amount of movement in the cam member 42. As a consequence, the combustion in the engine is promoted to further improve the acceleration characteristics for attaining the high rotation rate from the idle within a short period of time.

Further, the ECU 47 controls the fuel injection per unit time such that smaller the accelerator movement, the smaller the rate of fuel injection. Therefore, because of the reduced fuel injection in the idle, the combustion in the engine is suppressed to maintain the lower rotation rate. When the accelerator movement (cam position) increases, the fuel injection per unit time increases accordingly. Since the air flow amount and speed have already been achieved in the throttle valve 23, the increased fuel injection in proportion to the accelerator movement further promote the prompt response in the acceleration.

Suspending Operation in Selected Cylinder

Another features of the present invention resides in the fact that one or more selected cylinders are controlled to be inactive when the throttle valve 23 is in the idle state, i.e., during the range where the cam member 42 has not reached the pick-up position CP2 of FIG. 2. As described above, to improve the acceleration response from the idle, the throttle valve of the present invention is positioned to form a substantially large opening. This opening in the throttle valve 23 will increase the engine rotation speed. By reducing the number of active cylinders, however, it is possible to keep the engine rotation low in the idle even though the throttle valve 23 is substantially opened and thus the large amount of air flow and higher speed of air flow are configured in the engine.

In the preferred embodiment, two cylinders out of six are stopped their combustion when the accelerator is in the idle (the cam member is in the position CP1 in FIG. 2), and one cylinder is stopped its combustion during the range after the position CP1 and before the pick-up position CP2. After the pick-up position, the combustion control system of the present invention controls the engine so that all the cylinders are in operation.

Preferably, such a pause in the combustion is accomplished by not providing the fuel to the cylinder to be paused from the fuel injector while the ignition to the spark plug 38 is continuously provided. In this arrangement, it is possible to prevent the fuel which is not ignited being exhausted from the engine, since the fuel may still be left in the selected cylinder immediately after the fuel supply is ceased. The ECU 47 stores the map having information to control the pausing operation in the cylinders depending on the accelerator movement.

Figure 5:
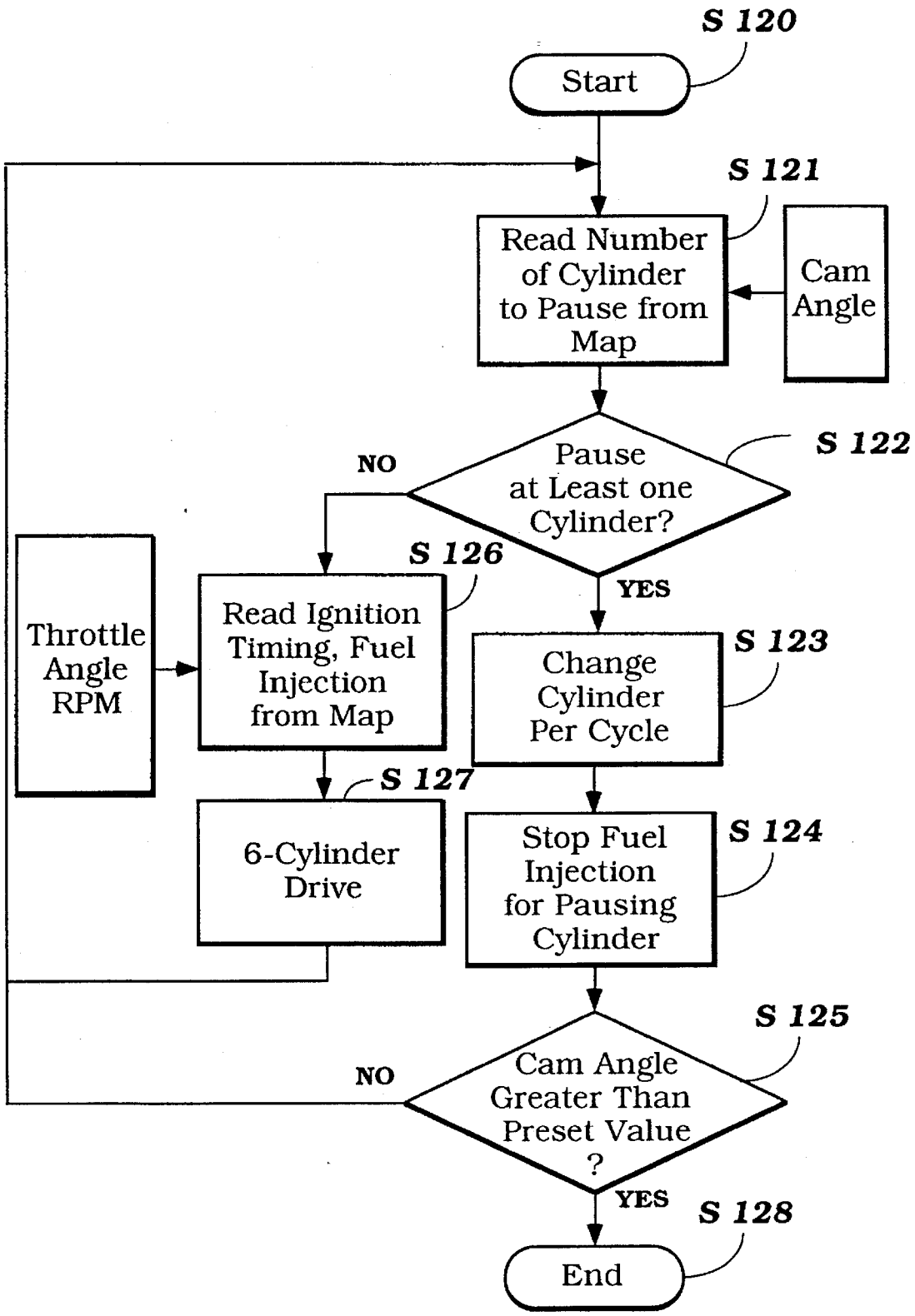
FIG. 5 is a flow chart showing the control routine for the idle state for selectively ceasing the cylinder operation in accordance with the combustion control system of the present invention.

FIG. 5 is a flow chart showing the control routine for the idle state for selectively pausing the cylinder operation in accordance with the combustion control system of the present invention. In FIG. 5, once the program starts in the step S120, it moves to the step S121 to retrieve the information as to the number of cylinders to be stopped combustion depending on the amount of movement in the cam member 42. The movement of the cam member 42 is sensed by the sensor 51 in the induction system 21 and the result is notified to the ECU 47.

In the next step S122, it is determined whether at least one cylinder among the numbers of cylinders obtained in the step S121 should actually be paused combustion. As mentioned above, this determination is made in response to the amount of cam movement. For example, when there is no movement in the cam member 42 from the idle position CP1, two cylinders will be set inactive, and when the cam member 42 is out of the idle position but before the pick-up position CP2, one cylinder will be paused. If is determined that at least one cylinder should be paused in the step S122, the program advances to step S123.

In the step S123, the ignition timing, the fuel injection amount and timing are set for the active cylinders based on the reading in the map. These ignition timing and fuel injection vary depending on the engine rotation speed. Preferably, from the reading in the map, a cylinder or cylinders to be paused will change to the other cylinders cycle by cycle in the engine. For example, in the first engine cycle, the first cylinder will be stopped operation, and in the next engine cycle, the second cylinder will be stopped operation while the first cylinder will be set to be active, and so on. In this arrangement, an air circulation for each cylinder will be improved and thus, an engine power immediately after all of the cylinders are set to active will not be inversely affected and can maintain sufficient air flow necessary for the immediate acceleration.

In the next step S124, the fuel injector 24 is controlled so that the fuel is not provided to the selected cylinder during the engine cycle. Therefore, the engine having six cylinders (V-6 engine) shown in FIG. 1 is set to the four-cylinder drive or the five-cylinder drive during the period when the throttle valve 23 is in the idle position TP2. As a result, even though a large amount of air flows through the throttle valve 23 of the present invention, the engine rotation rate can be kept low, which is suitable for the engine idle.

In this situation, as mentioned above, the ignition for all of the cylinders are continued to be provided. As a result, it is possible to prevent the fuel which is not fired from being exhausted from the engine, since the fuel may still be left in the selected cylinder immediately after the fuel supply is ceased. Since such unfired fuel from the engine is harmful for human health or environment protection, to supply the ignition to fire any remaining fuel in the cylinder is effective to prevent such harm.

In the next step S125, it is determined whether the cam member 42 has reached or exceeded the predetermined position, i.e., the pick-up position CP2 of FIG. 2. If the cam movement is smaller than the pick-up position, the program goes back to the step S121 to repeat the procedure of steps S121–S124. If the cam member 42 has attained the pick-up position CP2, then the process for suspending the selected cylinder will be over.

If it is determined in the step S122 that the reading of the numbers of the cylinder to be paused in the step S121 is zero, the program moves to the step S126. This is the case where the throttle valve 23 departs from the idle position for acceleration of the engine. In the step S126, the ignition timing, the fuel injection amount and fuel injection timing for the full-cylinder drive is read out from the map. These conditions vary depending on the amount of the opening in the throttle valve 23 and the rate of engine rotation. In the next step S127, all of the cylinder, i.e., six cylinders in the example of FIG. 1, are driven based on the data derived in the step S126.

As has been described, in the engine idle, since the throttle valve 23 is set to the intermediate position between the closed position and the open position and thus, the throttle valve 23 has a substantial opening. Therefore, when the accelerator pedal is initiated, the sufficient air flow amount and speed are already attained in the engine, the engine rotation quickly increases in response to the accelerator movement, thereby improves the acceleration of the engine. Further, during the period before the cam member 42 arriving at the pick-up position, one or more cylinders are set to be inactive by not supplying the fuel thereto. Thus, even though there is provided sufficient air flow to the engine in the idle, the overall engine rotation speed is controlled to be low. Furthermore, since such active and inactive operation in the selected cylinders is performed within the range where the throttle valve is unchanged (idle position), the combustion switching between the active and inactive in the cylinders is accomplished smoothly with high stability.

Backfire Suppression in Deceleration

Another features of the present invention is to suppress the backfire in the deceleration stage by adjusting the rate of change in the retard timing in the ignition and/or by increasing the amount of fuel provided to the engine. According to the first aspect of the present invention, the combustion control system for an engine is so arranged that the throttle valve 23 is substantially opened even in the idle state to provide the sufficient air flow to the engine so that the engine rotation speed will increase in response to the quick change-over from the idle to the acceleration.

In such a setting, one of the ways to control the engine rotation speed in the idle lower is to retard an ignition timing in the engine. However, since the timing retard will be increased when the engine is decelerated because the engine rotation is maintained by the inertia of the board such as a motor boat or motor vehicle wherein the engine is installed. As a result, a backfire occurs in such an engine deceleration wherein the air-fuel mixture ignites in an exhaust system or an intake manifold rather than in the crankcase chambers 19.

To prevent the backfire in the engine deceleration, the combustion control system of the present invention adjust the rate of change in the ignition timing depending on whether the engine is in a specific range where the backfire tends to occur or outside of such a range. If the engine is not in the range, the rate of change in the ignition delay will be set to a relatively large amount so that the ignition timing quickly changes to a large retard timing within a short period of time. If the engine is in the specific range where the backfire easily is caused, the rate of change in the ignition timing is adjusted to be small so that the ignition timing moves slowly to the retard timing, which will be effective to prevent the backfire. Whether the engine is in such a specific range or not is determined by such factors as the engine rotation speed, the amount of ignition delay, and other physical parameters which will be describe in more detail later.

Further, in the present invention, the fuel injection is controlled such that the amount of fuel injected to the engine will be increased when the engine is decelerated. This is because the backfire likely to occur when the fuel/air ratio is small, i.e., the mixture of the air and fuel is lean. Therefore, by increasing the fuel/air ratio, i.e., to make the mixture rich, the engine becomes less likely to cause the backfire. In the preferred embodiment, the ECU 47 controls both the rate of change in the ignition timing and the amount of fuel injection in the deceleration of the engine. However, it is not necessary to control both of them at the same time but it is also effective to control either one of them.

The ECU 47 stores the map listing the data for such adjustment of the rate of change in the ignition timing or the fuel injection amount to decrease the possibility of the backfire in the engine deceleration. The ECU 47 is provided with the signals indicative of the cam movement (accelerator movement), the throttle valve movement and other physical parameters to determine whether the engine is in the above risk range.

Figure 6:
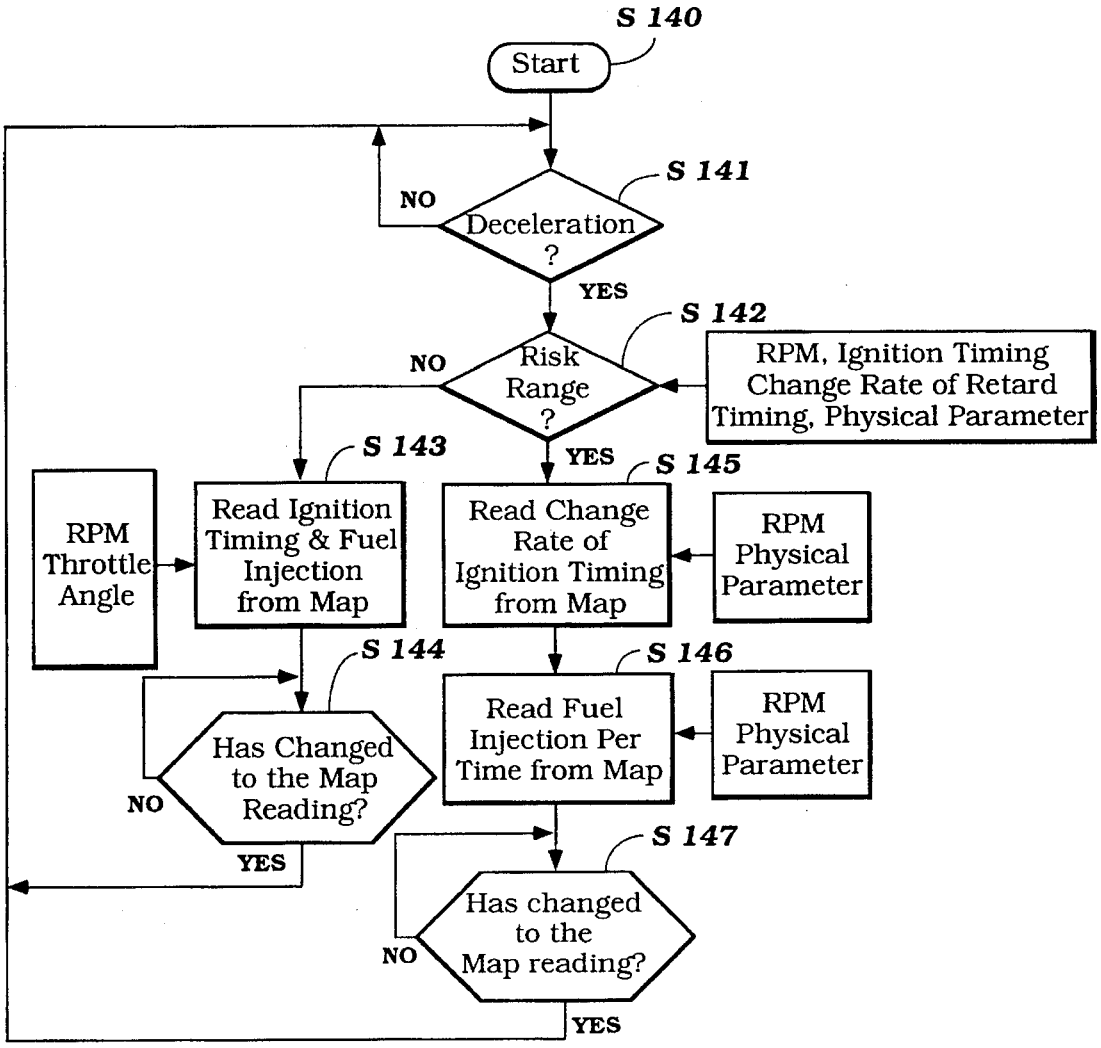
FIG. 6 is a flow chart showing the control routine for a deceleration state in the combustion control system of the present invention.

The control routine for preventing the backfire in the engine deceleration will be described with reference to the flow chart of FIG. 6 and the graphic views in FIGS. 7–10. In FIG. 6, once the program starts in the step S140, it moves to the step S141 wherein it is determined whether the engine is in the deceleration stage or not. If the engine is in the deceleration, the program moves to the step S142 wherein it is determined whether the engine is in a risk range based on the engine rotation speed, the ignition timing or the rate of change of the ignition timing, and other physical parameters.

Figure 7:
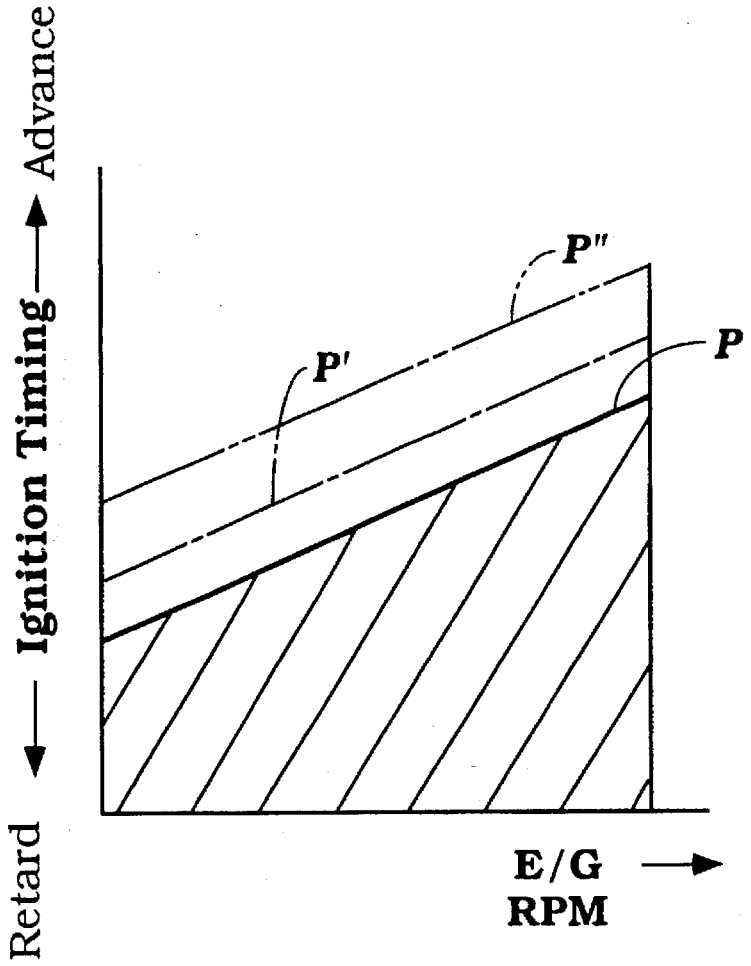
FIG. 7 is a graphic view showing a region described in terms of the engine rotation rate and the ignition timing where a backfire tend to occur in the engine.
Figure 8A:
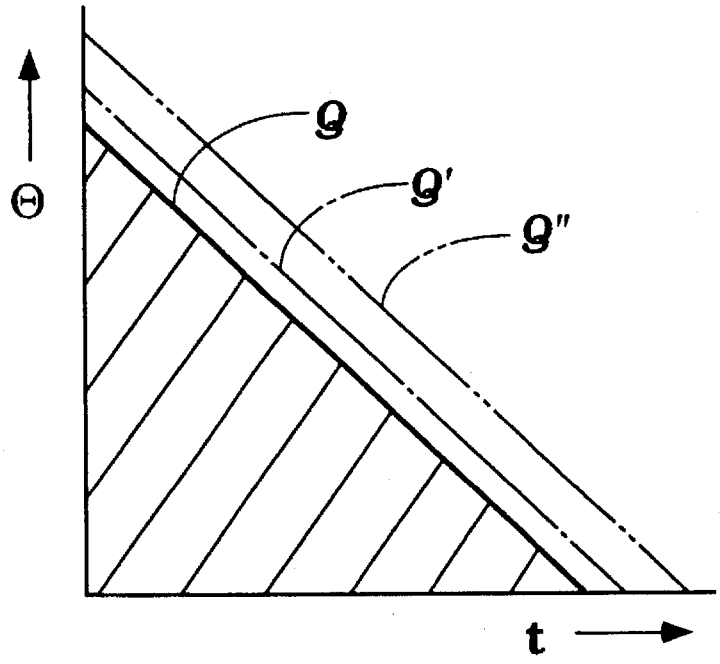
FIGS. 8A and 8B are graphic views showing regions described in terms of the amount of retard ignition timing and the rate of change in the retard ignition timing of the engine where backfires tend to occur.
Figure 8B:
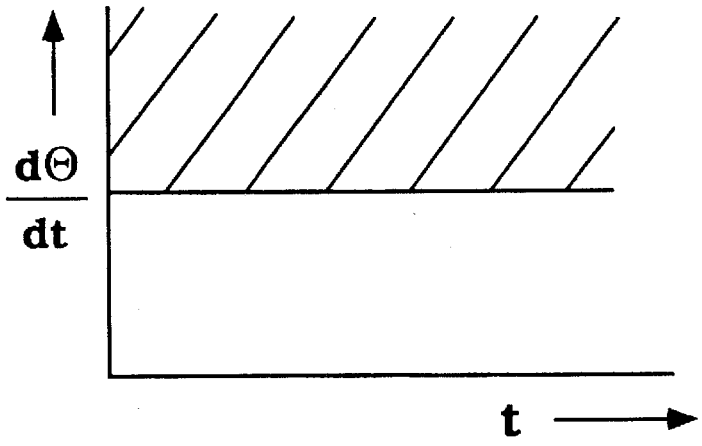

The risk range within this context is a region of engine characteristics in the deceleration where the backfire is likely to be caused so that the delay angle of the ignition timing and/or the fuel injection should be adjusted to prevent the backfire. Examples of the risk range are shown by the shaded areas of FIGS. 7 and 8. FIG. 7 shows a first risk range of the engine which is expressed by the engine rotation speed and the ignition timing. FIG. 8 shows a second risk range of the engine which is expressed by the rate of change in the retarded ignition timing.

The risk range also varies by the other physical parameters including an intake air temperature (or engine temperature), exhaust system back pressure, an amount of intake air, and an air/fuel ratio. The lower the intake air temperature, the more likely that the backfire occurs. Similarly, the possibility of the engine backfire increases with the increase of the exhaust system back pressure, decrease in the amount of intake air, and decrease of the air/fuel ratio (leaner mixture). As shown in FIGS. 7 and 8, the boarder lines P and Q of the risk ranges vary to the single dotted lines P', Q' or the double dotted lines P", Q" to expand the risk ranges depending on such physical parameters.

If it is determined that the engine is not in either of the risk ranges shown in FIG. 7 or 8, the program proceeds to the step S143. In the step S143, the data in the map regarding the ignition timing and the fuel injection amount and timing are read-out based on the engine rotation rate and the degree of throttle valve opening. In this situation, since it is unlikely that the backfire happens, the combustion control system of the present invention does not need to specifically adjust the ignition timing or the fuel injection. Thus, the data read-out from the map in the step S143 is not reflected by the backfire consideration but mainly based on the acceleration response in the engine.

In the step S144, the ECU changes the ignition timing to the spark plug 38 and fuel from the fuel injector 24 to the values obtained in the step S143. Such changes in the ignition timing is illustrated by the direct lines AB and BC of FIG. 9*a*. Similarly, such changes in the amount of fuel injection is illustrated by the direct lines AB and BC of FIG. 10*a*. Both in FIG. 9*a* and 10*a*, the points A correspond to the ignition timing delay (FIG. 9*a*) or the amount of fuel injection (FIG. 10*a*) where the throttle valve 23 is further opened from the idle position, i.e., between the idle positions TP 2 and the full open position TP3. The points B in FIGS. 9*a* and 10*a* correspond to the ignition timing delay and the amount of fuel injection, respectively, when the throttle valve 23 returns to the idle position because of the deceleration of the engine. Further, the points C indicate the ignition timing delay and the amount of fuel injection when the engine rotation speed has been substantially lowered because of the deceleration.

After the above setting in the step S144, the program returns to the steps S141 to determine whether the engine is in the deceleration stage and if so, proceeds to the step S142. If it is determined, in the step S142, that the engine is in the risk range, the process advances to the step S145 so as to acquire the data for adjusting the rate of change of the retard ignition timing from the map. Further, in the next step S145, the program acquires the data for adjusting the amount of fuel to be injected from the fuel injector 24. Such data of the change rate of ignition timing and the fuel injection vary depending on the engine rotation speed and the physical parameters of the engine at that time.

In the step S147, the ECU 47 changes the ignition timing and the amount of fuel injection to the readings in the map as obtained in the steps S145 and S146. After adjusting the ignition timing and the fuel injection, the program returns to the step S141. Thus, if the engine is in the risk range in the deceleration stage, the above steps S141–S147 are repeated until the engine is out of the risk range.

Figure 9A:
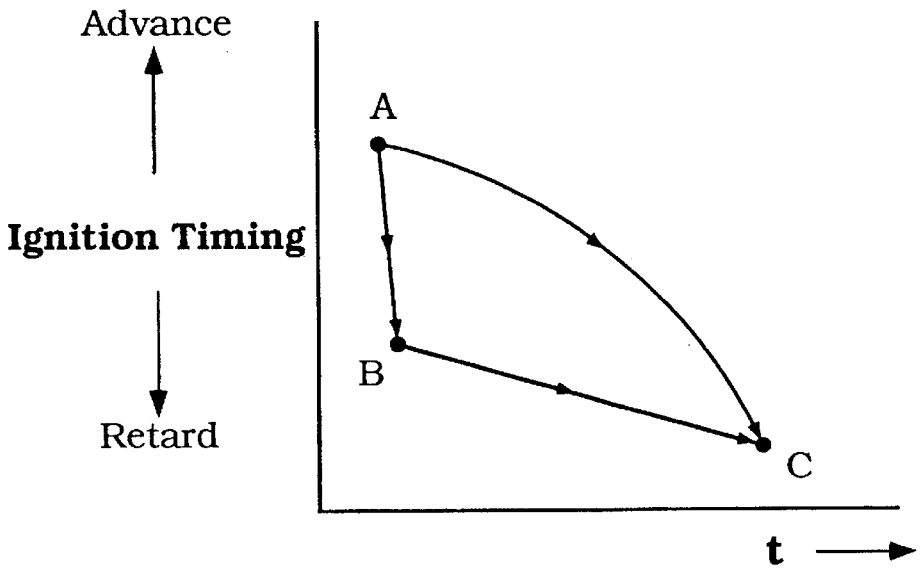
FIGS. 9A and 9B are graphic views for explaining the ignition timing control operation in accordance with the combustion control system of the present invention.
Figure 10A:
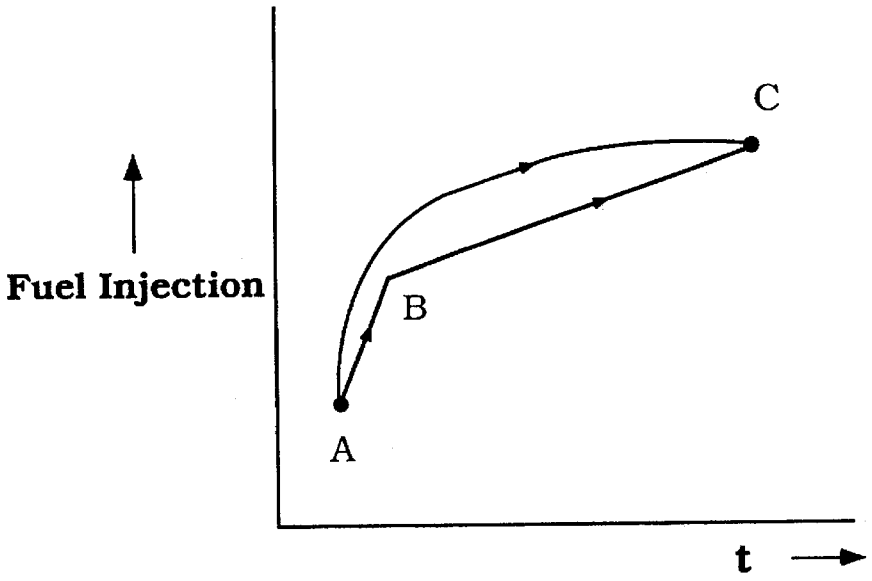
FIGS. 10A and 10B are graphic views for explaining the fuel injection control operation in accordance with the combustion control system of the present invention.

The curved lines AC in FIGS. 9*a* and 10*a* illustrate such adjustment of the ignition timing and the fuel injection, respectively, according to the present invention. As seen in FIG. 9*a*, the ignition timing from the start point A to the end point C vary slowly and smoothly and is adjusted without sudden changes to the retard timing. Also in FIG. 10*a*, the amount of fuel injection from the start point A to the end point C increases slowly and smoothly without sudden changes. As a result, the combustion control system of the present invention can effectively suppress the backfire during the deceleration.

Figure 9B:
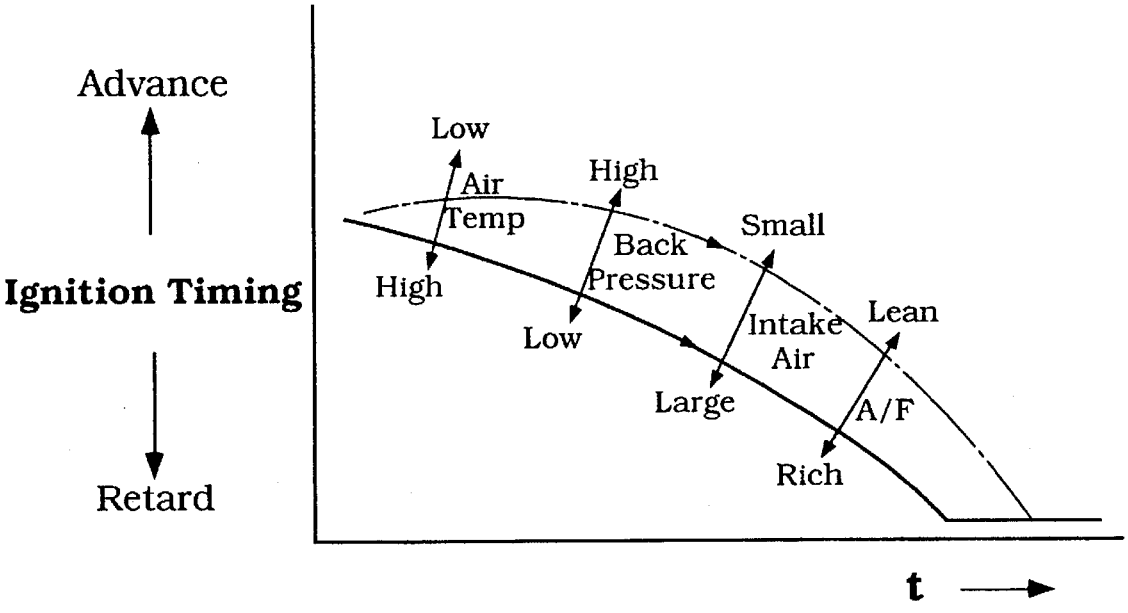
Figure 10B:
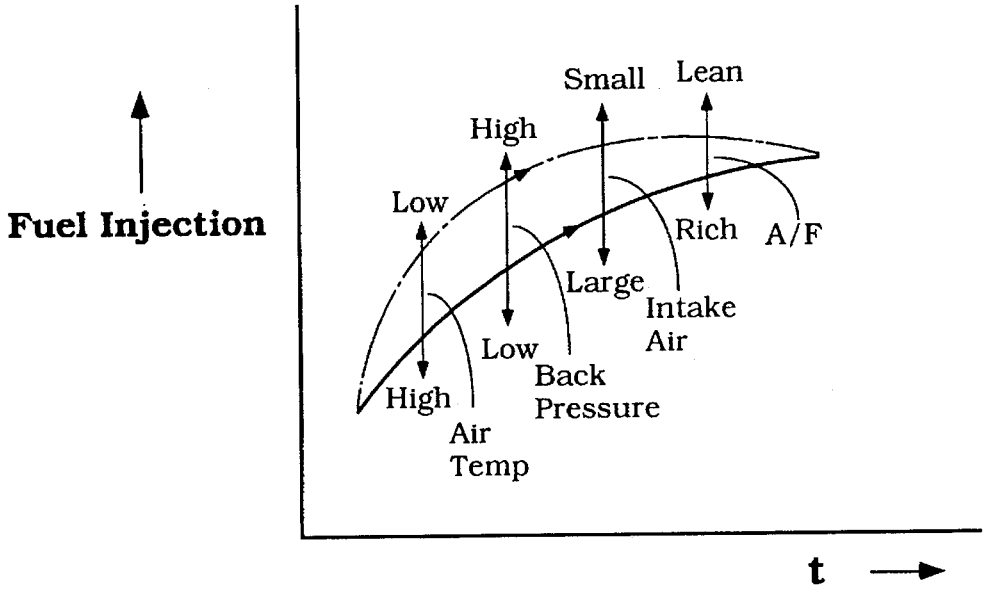

In the above adjustment of ignition timing and fuel injection, the program also considers the physical parameters to further effectuate the backfire prevention. This is shown in FIGS. 9*b* and 10*b* wherein the ignition timing and the fuel injection are additionally adjusted depending on the physical parameters. Namely, when the physical parameters of the engine are more likely to cause the backfire, i.e., the lower temperature in the intake air, the higher pressure in the exhaust system back pressure, the lesser amount of intake air, or the leaner the fuel/air mixture, the program additionally adjust the ignition timing and the fuel injection to show more slower and smooth change. Thus, the adjustment curves of the ignition timing and the fuel injection in FIGS. 9*b* and 10*b* shift from the dotted line to the solid line.

As has been described, in the engine idle, since the throttle valve 23 is set to the intermediate position between the closed position and the open position and thus, the throttle valve 23 has a substantial opening. Therefore, when the accelerator pedal is initiated, the sufficient air flow amount and speed are already attained in the engine, the engine rotation quickly increases in response to the accelerator movement thereby improves the acceleration of the engine. During the period before the cam member 42 arriving at the pick-up position, the ECU 47 controls the ignition timing in response to the amount of cam movement, i.e., the smaller the cam movement, the more delay in the ignition timing. In addition, the amount of fuel injected to the engine is also controlled depending on the cam movement, i.e., the smaller the cam movement, the less fuel supplied to the engine. Also during this period, one or more cylinders are set to be inactive by not supplying the fuel thereto. Thus, even though there is provided sufficient air flow to the engine in the idle, the overall engine rotation speed is controlled to be low. Further, since such active and inactive in the selected cylinders is performed within the range where the throttle valve is unchanged (idle position), the combustion switching between the active and inactive is accomplished smoothly with high stability.

In the engine deceleration, when the engine is in the range where the backfire tends to occur, the rate of change in the ignition delay is adjusted depending on the engine rotation speed, the ignition delay and the other physical parameters. Thus, in the range where the backfire likely to happen, the rate of change in the ignition delay timing is controlled to be small so that the ignition timing will change slowly and smoothly, which will suppress the backfire in the deceleration. Furthermore, in the engine deceleration, the ECU 47 controls the fuel injector 24 so that the amount of fuel provided to the engine will increase. Therefore, such an increase in the fuel make the air/fuel mixture rich, which will further suppress the backfire in the engine during the deceleration.

Although the foregoing description is made with respect to the preferred embodiments of the invention, various changes and modifications may be made without departing from the spirit and scope of the invention, as defined by the appended claims.

We claim:

1. A combustion control system for an internal combustion engine, comprising:

a throttle valve for controlling air flow through an opening thereof based on its angular movement, said throttle valve having an idle position which has a substantial opening for providing a sufficient air flow to the engine;

a cam member rotatably movable in response to an accelerator to regulate a rotation rate of said engine, said cam member disengaging with said throttle valve in a first region prior to a pick-up position and engaging with said throttle valve in a second region after said pick-up position to proportionally drive said throttle valve;

an electric control unit for controlling an overall procedure for said combustion control, said control unit being provided with information on the amount of movement of said cam member, said control unit changing ignition timing for said engine on the basis of amount of said cam member movement.

2. A combustion control system as defined in claim 1, wherein, said system further comprises:

a fuel injector for injecting fuel to said engine within a predetermined time, said fuel injector being controlled by said electric control unit so that amount of fuel injected in unity of time is decreased with the decrease in the amount of said cam member movement when said cam member is in said first region.

3. A combustion control system as defined in claim 2, wherein, said ignition timing is controlled such that said ignition timing is delayed with the decrease of said cam member movement when said cam member is in said first region.

4. A combustion control system as defined in claim 2, wherein, said throttle valve is in said idle position when said cam member is in said first region.

5. A combustion control system as defined in claim 2, wherein, said system incudes:

a cam sensor for detecting the amount of movement of said cam member;

a crank angle sensor for detecting the rotation rate of said engine.

6. A combustion control system as defined in claim 3, wherein, said controller includes a map for introducing the data for changing said ignition timing and said amount of fuel injection depending on said cam member movement and said engine rotation rate.

7. A combustion control system as defined in claim 3, wherein, said decrease in said fuel injection and said delay in said ignition timing interact to suppress the engine rotation rate to increase in the idle state wherein said cam member movement is minimum.

8. A combustion control system as defined in claim 3, wherein, said throttle valve has a pick-up bar, an end of said pick-up bar engaging with said cam member when said cam member reaches said pick-up position.

9. A combustion control system for an internal combustion engine, comprising:

a throttle valve for controlling air flow through an opening thereof based on its angular movement, said throttle valve staying in a idle position which has a substantial opening to provide a sufficient air flow to the engine;

a cam member rotatably movable in response to an accelerator to regulate a rotation rate of said engine, said cam member disengaging with said throttle valve in a first region prior to a pick-up position and engaging with said throttle valve in a second region after said pick-up position to proportionally drive said throttle valve;

an electric control unit for controlling an overall procedure for said combustion control, said control unit being provided with information on the amount of movement of said cam member, said control unit changing ignition timing for said engine on the basis of amount of said cam member movement;

a fuel injector for injecting fuel to said engine within a predetermined time, said fuel injector being controlled by said electric control unit so that amount of fuel injected in unity of time is decreased with the decrease in the amount of said cam member movement when said cam member is in said first region;

means for selecting at least one cylinder and pausing combustion in said selected cylinders at least when said cam member is in said first region.

10. A combustion control system as defined in claim 9 wherein the pausing of combustion in the selected cylinder is effected by discontinuing the supply of fuel by said fuel injector to said selected cylinder.

11. A combustion control system as defined in claim 10, wherein, said electric control unit continues to provide ignition to said selected cylinders while the fuel supply is suspended to said selected cylinders.

12. A combustion control system as defined in claim 9, wherein, said selection of said at least one cylinder for stopping said combustion is changed to other cylinders in series in a cycle by cycle basis of said engine.

13. A combustion control system as defined in claim 9, wherein, said electric control unit includes a map which stores information to determine the number of cylinders to be inactive on the basis of said amount of cam member movement.

14. A combustion control system for an internal combustion engine, comprising:

a throttle valve for controlling air flow through an opening thereof based on its angular movement, said throttle valve staying in a idle position which has a substantial opening to provide a sufficient air flow to the engine;

a cam member rotatably movable in response to an accelerator to regulate a rotation rate of said engine, said cam member disengaging with said throttle valve in a first region prior to a pick-up position and engaging with said throttle valve in a second region after said pick-up position to proportionally drive said throttle valve;

an electric control unit for controlling an overall procedure for said combustion control, said control unit being provided with information on the amount of movement of said cam member and said rotation rate of said engine, said control unit adjusting the rate of change in ignition timing for said engine during deceleration of said engine, said adjustment of rate of change in the ignition timing being made by judging, on the basis of said engine rotation rate and the amount of said ignition timing, whether said engine is in a range which is likely to cause a backfire.

15. A combustion control system as defined in claim 14, wherein, said system further comprises:

a fuel injector for injecting fuel to said engine within a predetermined time, said fuel injector being controlled by said electric control unit so that amount of fuel injected to said engine per cycle is increased during said deceleration of said engine when said engine is in said range which is likely to cause said backfire.

16. A combustion control system as defined in claim 15, wherein, said controller includes a map which stores information to determine the rate of change in said ignition timing and said amount of fuel injection and whether said engine is in said range during said deceleration.

17. A combustion control system as defined in claim 15, wherein, said rate of change in said ignition timing and said amount of fuel injection per cycle during said deceleration are additionally adjusted on the basis of other physical parameters including temperature of intake air in a crankcase of said engine, exhaust system back pressure of said engine, an air/fuel mixture ratio, and an amount of said intake air.

18. A combustion control system as defined in claim 17, wherein, said system includes a cam sensor for detecting the amount of movement of said cam member;

a crank angle sensor for detecting the rotation rate of said engine;

a pressure sensor for detecting said exhaust back pressure in said engine;

a temperature sensor for detecting said temperature of said intake air in said crankcase.

19. An internal combustion engine having at least one combustion chamber, an induction system including an induction passage for supplying at least an air charge to said combustion chamber, a charge forming system for supplying a fuel charge to said combustion chamber, an ignition system for igniting combustion in said combustion chamber, a throttle valve for controlling the flow of air through said induction passage, an accelerator operatively connected to said throttle valve for opening said throttle valve, said operative connection between said accelerator and said throttle valve being such that when said accelerator is in an idle position said throttle valve is in a partially opened position in which more air can flow to said combustion chamber than is required for its idle speed running and to a pick-up position wherein continued movement of said accelerator will initiate further opening of said throttle valve, and means for obtaining the desired idle speed of said engine when said accelerator is in its idle position and said throttle valve is in its partially opened position by controlling another system of the engine without effecting a change in the effective flow area of said induction passage.

20. An internal combustion engine as set forth in claim 19 wherein the other system comprises the ignition system.

21. An internal combustion engine as set forth in claim 20 wherein the idle speed is maintained by retarding the time of ignition.

22. An internal combustion engine as set forth in claim 21 further including means for deceasing the amount of ignition retardation upon deceleration caused by rapid closing of the throttle valve for precluding backfiring.

23. An internal combustion engine as set forth in claim 19 wherein the controlled system is the fuel charge forming system.

24. An internal combustion engine as set forth in claim 23 wherein the idle speed is maintained by reducing the amount of fuel supplied to the engine by the charge forming system.

25. An internal combustion engine as set forth in claim 23 wherein the ignition system is also controlled to assist in maintaining the idle speed.

26. An internal combustion engine as set forth in claim 25 wherein the idle speed is also maintained by retarding the time of ignition.

27. An internal combustion engine as set forth in claim 26 further including means for deceasing the amount of ignition retardation upon deceleration caused by rapid closing of the throttle valve for precluding backfiring.

28. An internal combustion engine as set forth in claim 19 wherein the engine is provided with a plurality of combustion chambers.

29. An internal combustion engine as set forth in claim 28 wherein the idle speed is maintained by disabling the combustion with selected ones of the combustion chambers.

30. An internal combustion engine as set forth in claim 29 wherein the combustion is disabled by controlling the fuel supply system so that fuel is not supplied to the disabled combustion chambers.

31. An internal combustion engine as set forth in claim 30 wherein the ignition system for the disabled combustion chamber continues to operate for burning any fuel which may remain in the disabled combustion chamber.

* * * * *